US005191924A

United States Patent [19]

Werquin

[11] Patent Number: 5,191,924

[45] Date of Patent: Mar. 9, 1993

[54] BUILT-UP INGOT MOLD FOR THE CONTINUOUS CASTING OF METAL

[75] Inventor: Dominique Werquin, Ronchin, France

[73] Assignees: Sollac, Paris; Clecim, Pontoise, both of France

[21] Appl. No.: 554,704

[22] Filed: Jul. 18, 1990

[30] Foreign Application Priority Data

Jul. 19, 1989 [FR] France ..... 89 09731

[51] Int. Cl.[5] ..... B22D 11/00

[52] U.S. Cl. ..... 164/418; 164/459

[58] Field of Search ..... 164/418, 459

[56] References Cited

U.S. PATENT DOCUMENTS 4,390,057 6/1983 Reuter ..... 164/418
4,947,925 8/1990 Wagstaff ..... 164/418

FOREIGN PATENT DOCUMENTS 179364 4/1986 European Pat. Off. ..... 164/418
668703 10/1964 Italy ..... 164/418
57-47557 3/1982 Japan ..... 164/418
47557 3/1982 Japan ..... 164/418
850280 8/1981 U.S.S.R. ..... 164/418
923727 4/1982 U.S.S.R. ..... 164/418

*Primary Examiner*—Richard K. Seidel
*Attorney, Agent, or Firm*—Fay, Sharpe, Beall, Fagan, Minnich & McKee

[57] ABSTRACT

A built-up ingot mold for the continuous casting of metal has four cooled plates (2, 3) delimiting between them a cavity (4). The corners of the cavity are cut by bevels (9) and each pair of opposite plates bear on corresponding bearing faces (8) of the plates (2) of the other pair of opposite plates. The plates (2, 3) can be tightened against one another by tightening devices (10) acting approximately perpendicularly to the bearing faces (8). The bevel (9) of each corner of the cavity (4) is formed by the hypotenuse of a right-angled triangle, the sides forming the right angle of which are each located in a plane formed by an inner wall of one of the adjacent plates (2, 3) and have a length greater than 30 mm.

4 Claims, 4 Drawing Sheets

BUILT-UP INGOT MOLD FOR THE CONTINUOUS CASTING OF METAL

BACKGROUND OF THE INVENTION

The present invention relates to a built-up ingot mold for the continuous casting of metal, particularly steel.

In continuous casting, particularly of steel slabs, use is made of ingot molds comprising four cooled plates which delimit between them a cavity for the formation of a cast slab which has a specific fixed cross-section. This cavity is rectilinear in the sense of the extraction of the slab and generally has an approximately rectangular cross-section.

The plates forming two opposite walls of the cavity of the ingot mold are pressed against bearing faces formed on the other plates forming the two other opposite walls of said cavity of the ingot mold. These bearing faces simultaneously form joining faces between the plates, in the sense that they extend as far as the cavity of the ingot mold and thus define joints between the inner faces of the plates.

The plates of this ingot mold are generally tightened against one another by tightening devices acting approximately perpendicularly to the bearing faces.

The slabs cast in this type of ingot mold are then subjected to rolling in order to obtain sheets.

In point of fact, during the rolling of certain sheets, laps form at the edge of the sheet panel which, if they are too deep, persist after drawing. This defect originates from a "flow" from the upper corner of the slab to the lower corner during widening.

For example, sheets made from thick slabs of approximately 300 mm are subjected to considerable cross rolling, since a slab approximately 1700 mm wide is converted into a sheet which has a width of 4500 mm approximately. In this case, in order to avoid laps, it is essential to provide a reserve of metal, that is to say an exceptional additional width of approximately 80 mm. This additional width constitutes a major loss of material.

One solution for avoiding this lap defect consists, for example, in removing the corners of the slab by producing a bevel at each corner, using a torch.

However, the production of bevels using a torch is much too costly in terms of metal lost and preparation.

Another solution consists in directly casting slabs which are beveled at the corners by using ingot molds which comprise four cooled plates delimiting a cavity, the corners of which are cut by bevels.

Various tests performed on beveled slabs demonstrate that the bevel must have specific dimensional characteristics in order totally to avoid the defect of a lap at the edge of sheets.

SUMMARY OF THE INVENTION

The subject of the present invention is a built-up ingot mold for the continuous casting of metal, particularly of slabs, comprising four cooled plates delimiting between them a cavity, the corners of which are cut by bevels and in which the plates of each pair of opposite plates bear on corresponding bearing faces of the plates of the other pair of opposite plates, the plates being intended to be tightened against one another by tightening devices acting approximately perpendicularly to the bearing faces, characterised in that the bevel of each corner of the cavity is formed by a hypotenuse of a right-angled triangle, the sides forming the right angle of which are each located in a plane formed by an inner wall of one of the adjacent plates and have a length greater than 30 mm.

According to a preferred characteristic of the invention, the sides forming the right angle of the right-angled triangle have a length between 30 and 150 mm, depending on the size of the slabs and the grade of steel to be cast.

According to other characteristics of the invention:

- the sides forming the right angle of the right-angled triangle are, respectively, equal to 80 mm and 50 mm for slabs which are 300 mm thick,
- the bearing faces between the adjacent plates are inclined towards the inside of the ingot mold by an angle between 5° and 7°,
- the bevel of each corner of the cavity is formed on the pair of plates constituting the small walls of said cavity,
- the large side of each right-angled triangle is located in a plane formed by each large wall of the cavity,
- the plates forming the small walls of the cavity comprise, on the opposite side from each bearing face on the adjacent plate, a block bearing on a lateral face of an extension of said adjacent plate and which is long enough to take up the bending stresses caused by heat shrinkage,
- each block comprises a zone spaced from the lateral face of the extension of the adjacent plate and a thinned-down zone exerting a force antagonistic to the heat shrinkage,
- the devices for tightening the plates consist of jacks comprising means for adjusting the force and for maintaining the tightening,
- the means for adjusting the force and for maintaining the tightening consist of a stack of hydraulically prestressed elastic washers.

BRIEF DESCRIPTION OF THE DRAWINGS

Other characteristics and advantages of the present invention will become apparent during the following description which is made with reference to the appended drawings, in which.

DETAILED DESCRIPTION OF THE PREFERRED EMBODIMENT

Figure 1:
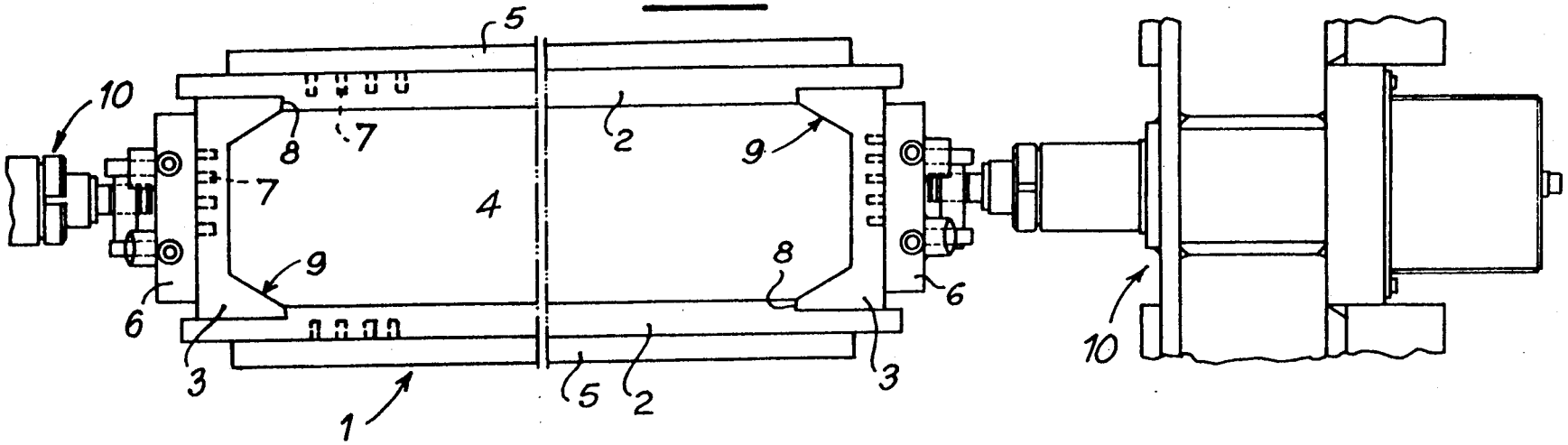
FIG. 1 is a diagrammatic plan view of a built-up ingot mold according to the invention.
Figure 2:
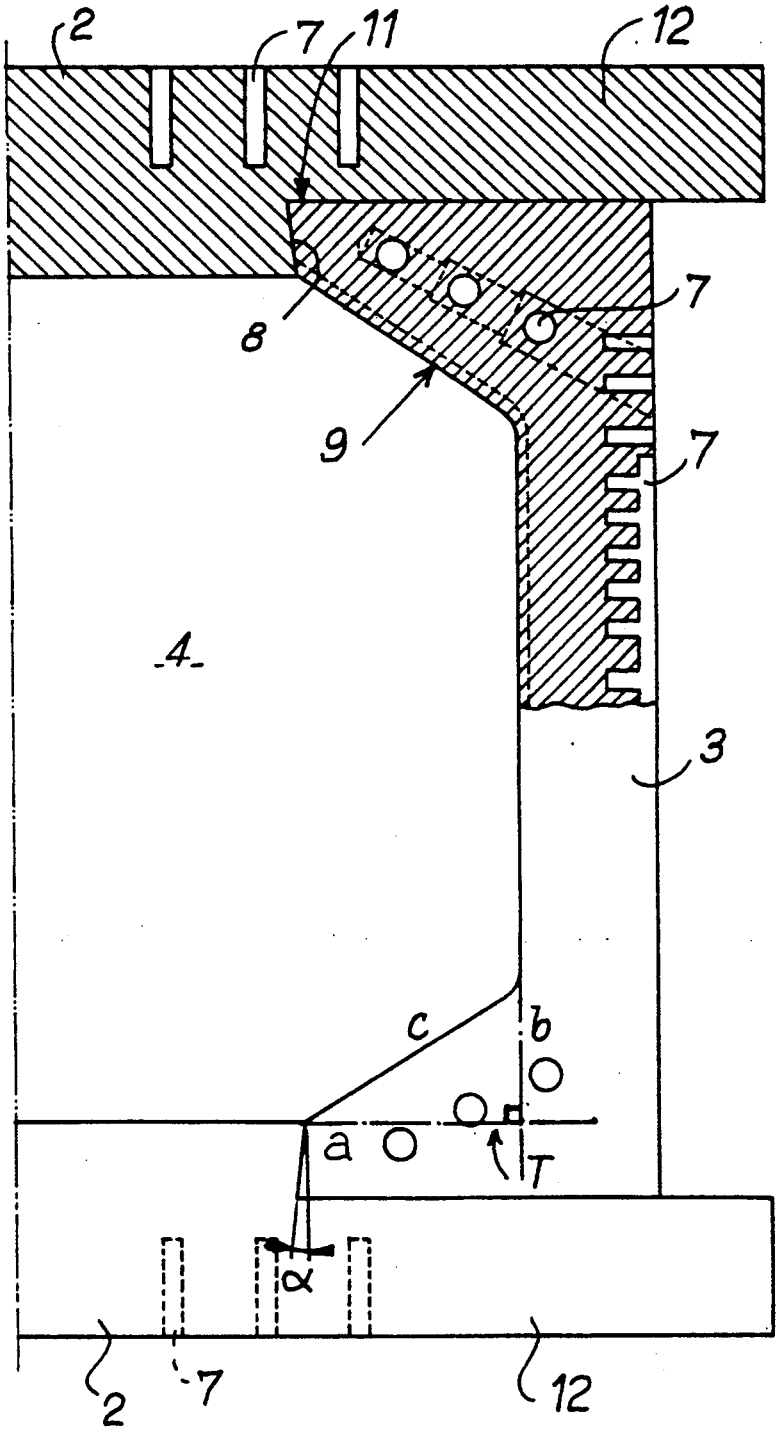
FIG. 2 is a diagrammatic plan view, on a larger scale and in half section, of one small plate of the ingot mold.

With reference, firstly, to FIGS. 1 and 2, it can be seen that the ingot mold 1 for the continuous casting of steel comprises two large opposite plates 2 and two small opposite plates 3 which delimit between them a cavity 4 which is rectilinear in the direction of extraction of the slab and of approximately rectangular cross-section.

The plates 2 and 3, made from copper or from copper alloy, are fixed to reinforcement plates made from steel, respectively 5 and 6, and are equipped with grooves 7 which are provided for the passage of a suitable coolant, such as water.

The small plates 3 bear on corresponding bearing faces 8 of the two large plates 2.

Moreover, the plates 2 and 3 are tightened against one another by tightening devices 10 which act on each small plate 3 by means of corresponding reinforcement plates 6 in a direction which is approximately perpendicular to the bearing faces 8.

The corners of the cavity 4 are cut by bevels 9.

These bevels 9 are produced on the pair of small plates 3 and, as may be seen in FIG. 2, they are each formed by the hypotenuse "c" of a right-angled triangle T, the sides "a" and "b" of the right angle of which have a length greater than 30 mm and, preferably, between 30 and 150 mm.

In the example shown, the side "a" has a length equal to 80 mm and the side "b" has a length equal to 50 mm.

The side "a" of each right-angled triangle T is located in the plane of the inner wall of the adjacent large plate 2 and the side "b" is located in the plane of the inner wall of the small plate 3 on which the corresponding bevel 9 is formed.

The small plates 3 are connected to the large plates 2 via bearing faces 8 which are inclined towards the inside of the ingot mold 1 by an angle between 5° and 7°.

To this end, each longitudinal wall of the large plates 2 comprises, firstly, a relief 11 whose edge is also inclined towards the inside of the ingot mold by an angle between 5° and 7° and, secondly, an extension 12 which forms, with said relief 11, a slanting-edge housing for the adjacent small plate 3.

This housing makes it possible substantially to improve the seal between the plates 2 and 3 of the ingot mold.

During rolling, it has been observed that the lap defect is caused by a flow from the upper corner of the slab to the lower corner and that this occurs during lengthening.

The lap is larger the greater the thickness of the slab.

Various slabs approximately 300 mm thick have been cast, each having bevels of specific dimensions.

The lap defects of the edges of the sheets obtained after rolling the slab have been compared and shown in FIGS. 3A to 3D.

FIGS. 3A, 3B, 3C and 3D show sectional images of the head, center and foot, respectively, of one edge of a rolled sheet obtained after rolling slabs with bevels of respective dimensions expressed in mm: 30×20; 50×65; 60×65; 80×50.

A sheet produced from a slab 300 mm thick, without a bevel, not shown in the Figures, has a lap of approximately 40 mm with an average loss of material of 80 mm.

Figure 3A:
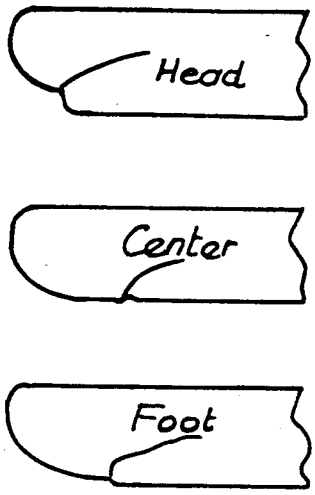
FIGS. 3A to 3D show sectional images of one edge of rolled sheets after rolling slabs.
Figure 3B:
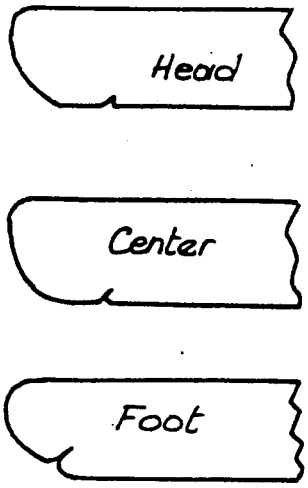
Figure 3C:
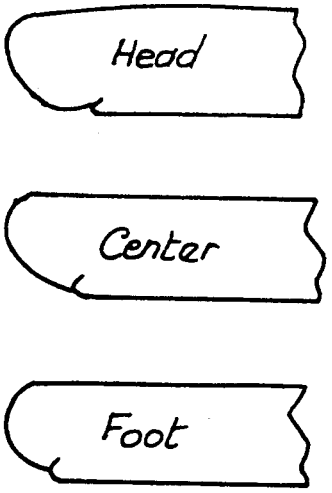

When the bevel corresponds to a right-angled triangle, the sides forming the right angle a×b of which are respectively equal to 30×20 mm, the lap is 10 mm but affects only 30 mm of edge (FIG. 3A).

When the bevel corresponds to a right-angled triangle, the sides forming the right angle a×b of which are, in size, greater than 30 mm, it is noted that the lap effect is now only approximately 3 mm and affects no more than 15mm of edge (3B and 3C).

Figure 3D:
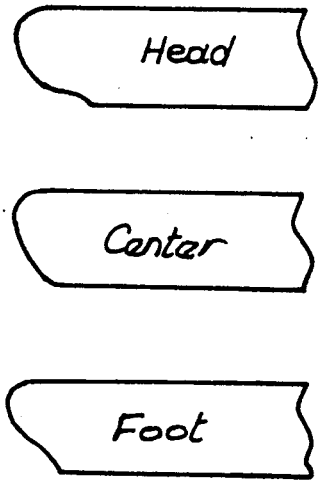

According to a preferred form, when the bevel corresponds to a right-angled triangle, the edges forming the right angle a×b of which respectively have a dimension 80×50 mm, it is observed, remarkably, that the lap totally disappears (FIG. 3D).

Figure 4:
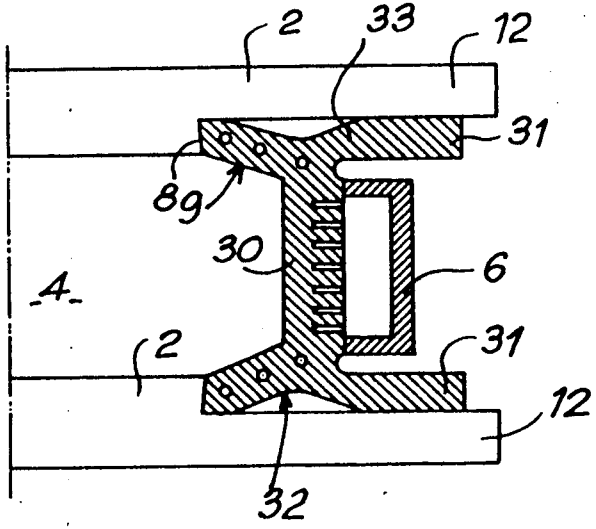
FIG. 4 is a diagrammatic plan view of an alternative embodiment of the small plate of the ingot mold.

According to an alternative embodiment shown in FIG. 4, each small plate 30 of the ingot mold 1 comprises, on the opposite side from the bearing faces 8, a block 31 which bears on the lateral face of the extension 12 of each adjacent large plate 2. The block 31 is long enough to take up the bending stresses caused by heat shrinkage.

Moreover, each block 31 can comprise a zone 32, which is not in contact with the lateral face of the extension 12, and a thinned-down section 33 which creates a lever arm which exerts a force which is antagonistic to the heat shrinkage.

Figure 5:
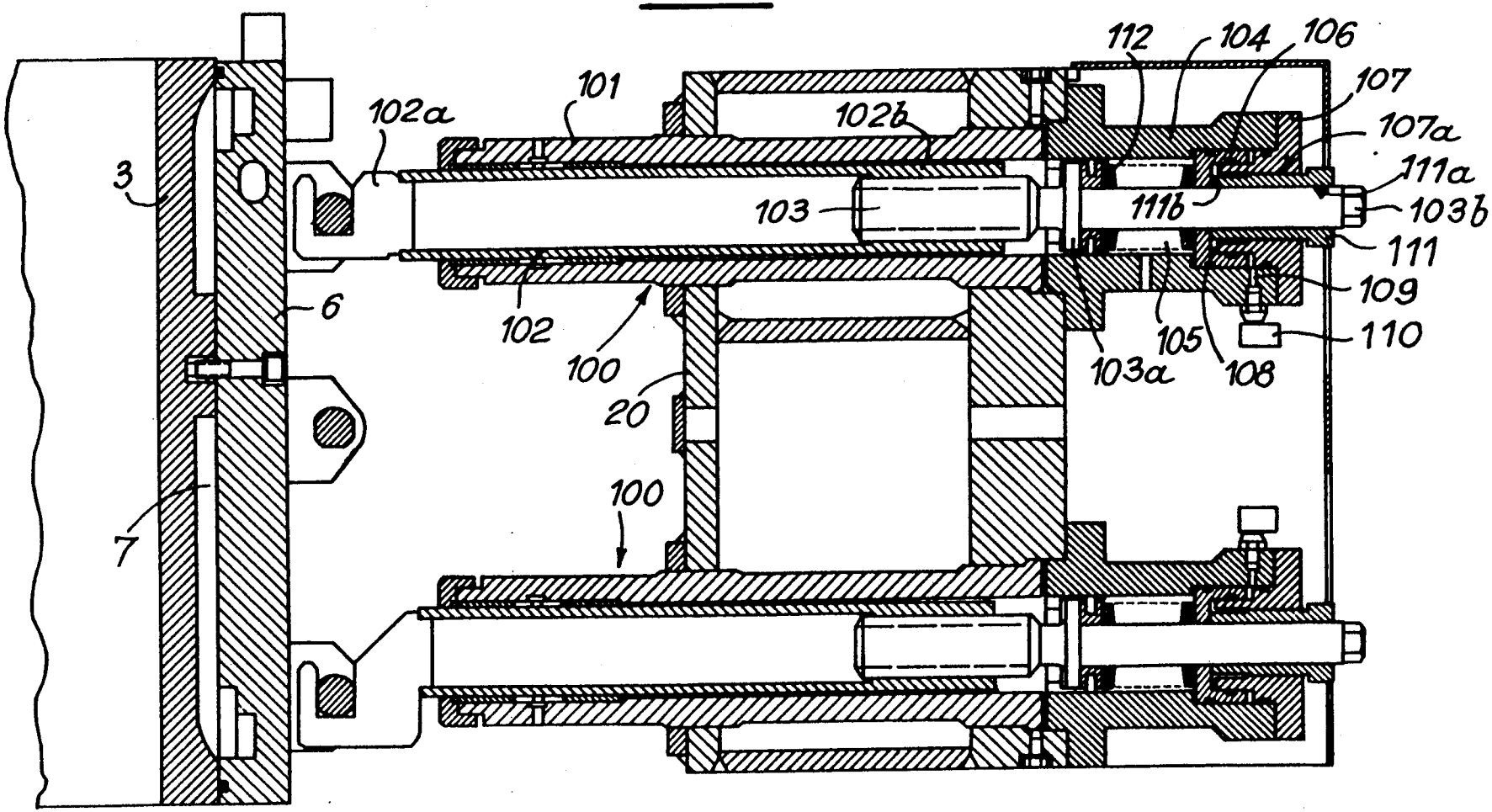
FIG. 5 is a sectional view, on a larger scale, of a device for tightening the plates of the small faces of the ingot mold.

With reference, now, to FIG. 5, a description will be given of the tightening device 10. This figure shows a tightening device which exerts a force on a small plate 3, the tightening device exerting a force on the opposite small plate being identical.

The tightening device 10 comprises two jacks 100 which are superposed in a vertical plane.

The jacks 100 of each jack unit are connected to one another by a spacer 20.

Each jack 100 comprises a cylinder 101 in which is slidably mounted a hollow rod 102, one end **102*a* of which is connected to the reinforcement plate 6 of the corresponding small plate 3**.

A maneuvering rod 103, which passes through a housing 104 fixed to the end of the cylinder 101, is screwed into the other end **102*b* of the hollow rod 102**.

The maneuvering rod 103 which comprises a shoulder **103*a* which, with the housing 104 and the body of said maneuvering rod 103, forms an inner chamber 105 which is closed by a piston 106 mounted slidably on the body of the rod 103 and inside the housing 104**.

A cover 107, forming a small inner chamber 108 with the piston 106, into which chamber emerges a small channel 109 which may be connected by a connector 110 to a pump (not shown), is fixed to the end of the housing 104.

The cover 107 comprises a threaded inner bore **107*a* in which a screw 111 is screwed. This screw 111 also comprises an inner bore 111*a* which enables the body of the rod 103 to pass through said screw. The end 111*b* of the screw 111 is in contact with the piston 106**.

A stack of elastic washers 112 is mounted on the body of the rod 103, in the chamber 105 between the shoulder **103*a* and the piston 106**.

The operation of tightening the plates 2 and 3 of the ingot mold 1 is performed in the following manner.

Firstly, the large plates 2 are tightened in order to come into contact, without force, with the small plates 3, then the small plates 3 are tightened by acting on the maneuvering screw 103 which, for this purpose, comprises a hexagonal nut **103*b* so that the bearing faces 8 of the small plates 3 and the large plates 2** come into contact.

This operation is performed in successive stages between the maneuvering rod 103 of the upper jack and the lower jack.

Next, after having connected a pump to the connector 110, the small chamber 108 is pressurized, which results in the displacement of the piston 106, compression of the elastic washers 112 and the exertion of a specific force on the small plate 3 via the rod 102.

In order to keep this force constant, the screw 111 is turned so that its end **111*b* comes into contact with the piston 106**, which enables the pump to be disconnected.

The hydraulically prestressed elastic washers 112 thus exert a virtually constant force on the small plate 3, permitting take-up of the displacements caused by expansion during casting.

By virtue, in particular, of the dimensional characteristics of the corner bevels of the cavity, the built-up ingot mold according to the invention makes it possible to totally eliminate the defect of a lap at the edge of a sheet and to do so without any effect on the quality of the product obtained.

I claim:

1. A built-up ingot mold for the continuous casting of metal, said mold comprising a large pair and a small pair of opposed cooled plates (2,3; 2,30), said large and small pairs of opposed plates deliminting between them a cavity (4), said cavity having corners, said corners being cut by bevels (9), said large pair of opposed plates bearing on corresponding bearing faces (8) of said small pairs of opposed plates (2), said large and small pairs of opposed plates (2,3; 2,30) being intended to be tightened against one another by tightening devices (10) acting approximately perpendicularly to said bearing faces (8), each of said bevels and corners forming a right triangle, each of said right triangles having a hypotenuse, a large side, and a small side, characterized in that said bevel comprises said hypotenuse, said large side being located in a plane of an inner wall of each of said large plates, said small side being located in a plane of an inner wall of each of said small plates, said small side having a length not equal to a length of said large side, said length of said small side being greater then 30 mm characterized in that the sides forming the right angle of the right-angled triangle are, respectively, equal to 80 and 50 mm for slabs which are 300 mm thick.

2. Built-up ingot mold for the continuous casting of metal, the mold comprising four cooled plates, (2,3; 2,30) delimiting between them a cavity (4), the corners of which are cut by bevels (9) and in which pairs of opposite plates (3,30) bear on corresponding bearing faces (8) of the plates (2) of the other pair of opposite plates, the plates (2,3; 2,30) being intended to be tightened against one another by tightening devices (10) acting approximately perpendicularly to the bearing faces (8), characterized in that the bevel (9) of each corner of the cavity (4) is formed by the hypotenuse of a right-angled triangle, the sides forming the right angle of which are which located in a plane formed by an inner wall of one of the adjacent plates (2,3; 2,30) and have a length greater than 30 mm, the bearing faces (8) between the adjacent plates (2,3; 2,30) are each inclined towards the inside of the ingot mold (1) by an angle between 5° and 7°.

3. A built-up ingot mold for the continuous casting of metal, said mold comprising a large pair and a small pair of opposed cooled plates (2,3; 2,30), said large and small pairs of opposed plates delimiting between them a cavity (4), said cavity having corners, said corners being cut by bevels (9), said large pair of opposed plates bearing on corresponding bearing faces (8) of said small pairs of opposed plates (2), said large and small pairs of opposed plates (2,3; 2,30) being intended to be tightened against one another by tightening devices (10) acting approximately perpendicularly to said bearing faces (8), each of said bevels and corners forming a right triangle, each of said right triangles having a hypotenuse, a large side, and a small side, characterized in that said bevel comprises said hypotenuse, said large side being located in a plane of an inner wall of each of said large plates, said small side being located in a plane of an inner wall of each of said small plates, said small side having a length not equal to a length of said large side, said length of said small side being greater than 30 mm, characterized in that said small pair of opposed plates (30) comprise a block (31), said block (31) bearing on a lateral face of an extension (12) of one of said large plates (2), said block having a length sufficient to substantially dissipate bending stresses caused by heat shrinkage of said block, characterized in that each block (31) further comprises:

a zone (32), said zone being a recess in said block (31) spaced from the lateral face of the extension (12) of said one of said large plates (2); and, a thinned-down section (33), said thinned-down section (33) of said block creating a lever arm, thereby resisting forces generated by heat shrinkage of said block.

4. A built-up ingot mold for the continuous casting of a metal slab said slab having a thickness, said mold comprising a large pair and a small pair of opposed cooled plates (2,3; 2,30), said large and small pairs of opposed plates delimiting between them a cavity (4), said cavity having corners, said corners being cut by bevels (9), said large pair of opposed plates bearing on corresponding bearing faces (8) of said small pairs of opposed plates (2) said large and small pairs of opposed plates (2,3; 2,30) being intended to be tightened against one another by tightening devices (10) acting approximately perpendicularly to said bearing faces (8), each of said bevels and corners forming a right triangle, each of said right triangles having a hypotenuse, a large side, and a small side, characterized in that said slabs have a certain thickness, said bevel comprises said hypotenuse, said large side being located in a plane of an inner wall of each of said large plates, said small side being located in a plane of an inner wall of each of said small plates, said small side having a length not equal to a length of said large side, said length of said small side being between 10% and 20% of the thickness of said slab and said length of said large side being between 20% and 30% the thickness of said slab, where the thickness of said slab is between 250 mm and 350 mm, the length of said small side is between 40 mm and 60 mm, and the length of said large side is between 70 mm and 90 mm.

* * * * *